United States Patent [19]

Braun

[11] 4,366,931

[45] Jan. 4, 1983

[54] CRUSHING DEVICE

[76] Inventor: Gert Braun, Hofackerstrasse 12 a, 4300 Essen-Heisingen, Fed. Rep. of Germany

[21] Appl. No.: 180,855

[22] Filed: Aug. 25, 1980

[30] Foreign Application Priority Data

Aug. 24, 1979 [DE] Fed. Rep. of Germany ..... 2934213

[51] Int. Cl.[3] ..... B02C 13/06

[52] U.S. Cl. ..... 241/186 R; 241/189 R

[58] Field of Search ..... 241/186 R, 189 R, 238

[56] References Cited

U.S. PATENT DOCUMENTS

| | | | |
|---|---|---|---|
| 1,988,820 | 1/1935 | Wagnon | 241/238 |
| 3,061,210 | 10/1962 | Schaeffer | 241/27 |
| 3,825,192 | 7/1974 | Knight | 241/189 R |
| 4,047,673 | 9/1977 | Aulmann et al. | 241/186 R |

FOREIGN PATENT DOCUMENTS

| | | | |
|---|---|---|---|
| 1112876 | 8/1961 | Fed. Rep. of Germany | 241/238 |
| 2623304 | 8/1977 | Fed. Rep. of Germany | 241/186 R |

*Primary Examiner*—John McQuade

*Attorney, Agent, or Firm*—McGlew and Tuttle

[57] ABSTRACT

A crushing device is disclosed for fragmenting coarse material which includes a frame, an elongated housing mounted to the frame for oscillatory motion about a horizontal swing axis adjacent a first end of the housing, a rotatable crushing roller mounted in the housing adjacent a second opposite end of the housing, a conveyor trough movably mounted to the frame spaced from the crushing roller by a distance defining a passage clearance for the material to be crushed therebetween, a mechanism for damping the oscillatory motion of the housing, a drive laterally connected to a first side of a housing for driving the crushing roller and a counterweight laterally connected to a second side of the housing for counterbalancing the drive.

10 Claims, 4 Drawing Figures

CRUSHING DEVICE

FIELD AND BACKGROUND OF THE INVENTION

The invention relates, in general, to the construction of crushers and, more particularly, to a new and useful crusher of the type in which a crusher supported in a housing which is movably mounted to a base frame by means of damping elements for crushing a coarse material in a trough located beneath the crusher and including a crusher drive assembly mounted to the housing.

Such crushing devices serve the purpose of fragmenting coarse material, particularly coal or other minerals, at the end of a conveyor. Single or double roll crushers used for continuous crushing of a coarse material are generally provided with a vertical clearance between the crushing roll and a trough therebelow which determines the section of passage and the size to which the conveyed material is crushed.

In known devices, the damping elements, usually designed as piston cylinder systems are connected to the crushing roll. Such systems provide a so-called floating mounting for the housing of the crushing roll upon a base frame. However, considerable reactive forces still occur between the crusher housing and the base frame since the drive assembly, comprising a motor, a clutch and a transmission represent an eccentrically mounted mass by which inertia effects are produced which result in strong loads on the mobile system. For this reason, known devices cannot be operated without other damping elements since premature wear and disturbances in the operation of the piston cylinder systems cannot be eliminated. The invention provides remedial measures in this regard.

SUMMARY OF THE INVENTION

The invention is directed to an improved crushing device of the above-mentioned kind which largely compensates for the reciprocating inertia forces and operates substantially without reactive forces.

It is an object of the invention to provide a crushing device for fragmenting coarse material which includes a frame, an elongated housing, means for mounting the housing to the frame for oscillatory motion about a horizontal swing axis adjacent to a first end of the housing, a rotatable crushing roller mounted in the housing adjacent a second end opposite said first end of the housing, a conveyor trough movably mounted to the frame spaced from the crushing roller by a distance defining a passage clearance for the material to be crushed therebetween, means for damping the oscillatory motion of the housing, drive means laterally connected to a first side of the housing for driving the crushing roller, and a counterweight laterally connected to a second side of the housing, the second side being disposed opposite to the first side, for counterbalancing the drive means.

The inventive arrangement is based on the experience that an appreciable compensation for the inertia forces is obtained if the center of gravity of the drive assembly is located above the axis of oscillation of the crusher housing and if, in addition, a counterweight is provided at the other side of the housing. With such an arrangement, and with the crusher housing performing an up and down oscillatory motion, the drive assembly only executes a torque-free pivotal movement. Consequently, the loads on the entire moving crusher system are minimized so that the inertia effects close to neutralize one another and in practice, no reactive forces occur. In any case, the reactive forces between the continuous crusher and the base frame are considerably reduced so that particularly stable and heavy constructions are no longer needed for supporting and damping the crusher housing.

It is a further object of the invention to provide an improved arrangement in which a guide pin is connected to the housing and a guide box having a substantially vertically extending socket is mounted on the frame intermediate the mounting means and the damping means, and the socket is proportioned for movably receiving and guiding the guide pin.

The guide pin and guide box arrangement ensures a well defined seating of the continuous crusher on the base frame of the conveyor and, particularly its lateral stability. To provide an enclosed structure, the invention provides that the frame includes vertically extending side sheets either respectively overlying the first and second sides of the housing or received in respective recesses of the first and second sides of the housing. This enlarges the sectional area of passage of the base frame and ensures that no gaps form between the oscillating crusher housing and the base frame, through which crushed material might laterally fall out. It is also provided that in the vicinity of the inlet end, side plates are secured to the frame with support brackets for supporting the damping means and which are provided with supporting flanges for the guide locks. In this way a relatively large unobstructed cross-sectional area is obtained for the crushing operation. The damping and guide elements remain screened against the material passing therethrough and are thereby protected. The design may be such that the damping elements are designed as metal-rubber elements including damping pistons connected to the crusher housing and damping cylinders which are secured to the brackets and having a rubber packing filling the cavity within the cylinders on either side of the piston. The arrangement of the drive assembly and utilization of inertia forces actually make it possible to use for the damping only metal-rubber elements, while in the prior art arrangements piston and cylinder systems are needed.

A substantial advantage of the inventive arrangement is that a crushing device of the above-mentioned kind, particularly a single-roll crusher, is obtained in which the inertia forces are compensated to a large extent by an optimal arrangement of the drive assembly and a provided counterweight. This substantially neutralizes the inertia effects within the moved system so that constraining reactive forces hardly ever occur between the crusher and the base frame. During the up and down oscillatory movement of the crusher housing, the drive assembly only executes a lever motion about its center-of-gravity axis and does not produce any torque. The loads resulting from the inertia forces of the reciprocating crusher are minimized so that in spite of the less heavy construction, wear is considerably reduced and the life of the device is extended. The design is particularly suitable for use in thin seams or low workings since the flat construction makes it possible to mount the crusher directly on or above the conveyor.

It is a further object of the invention to provide an improved crushing device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
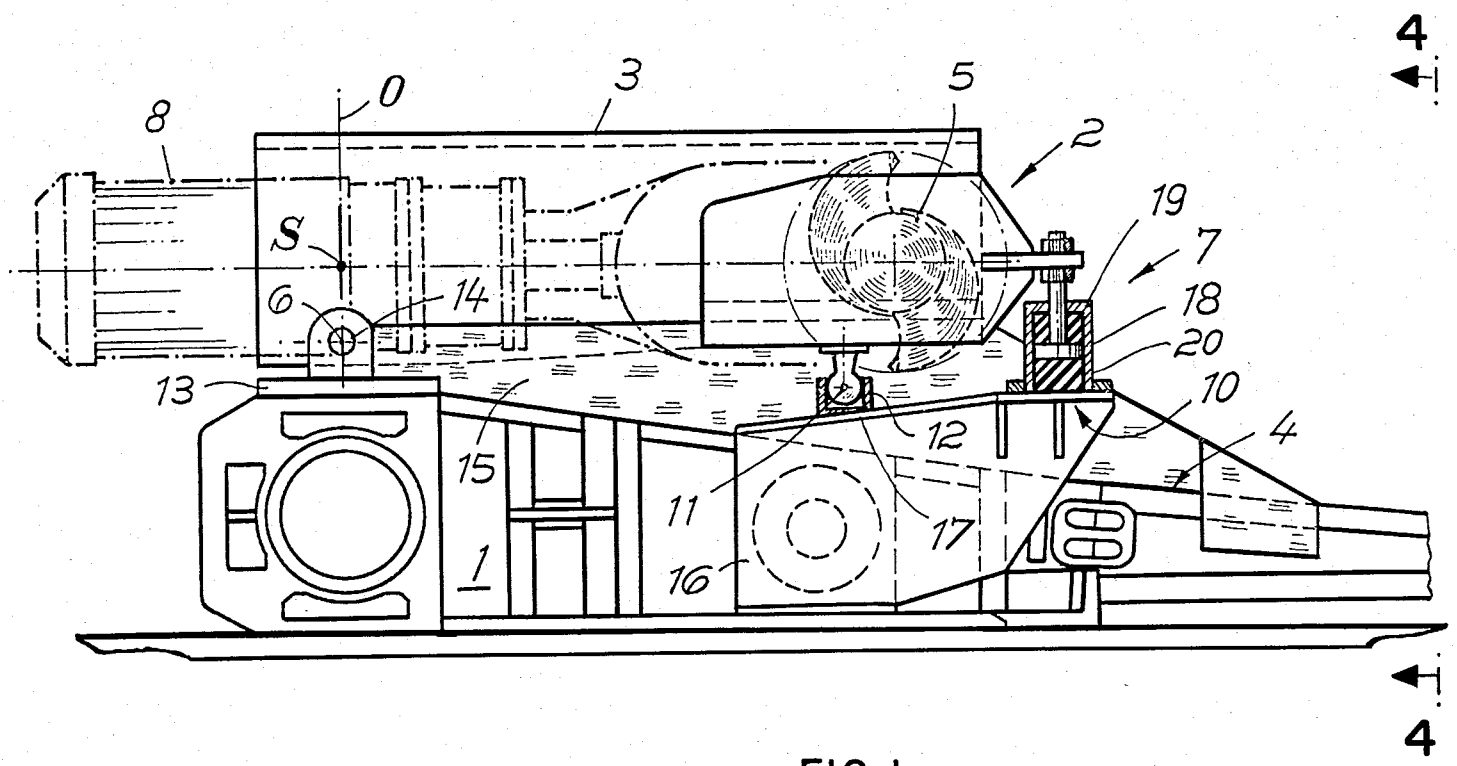
FIG. 1 is a side elevational view of the inventive crushing device.
Figure 2:
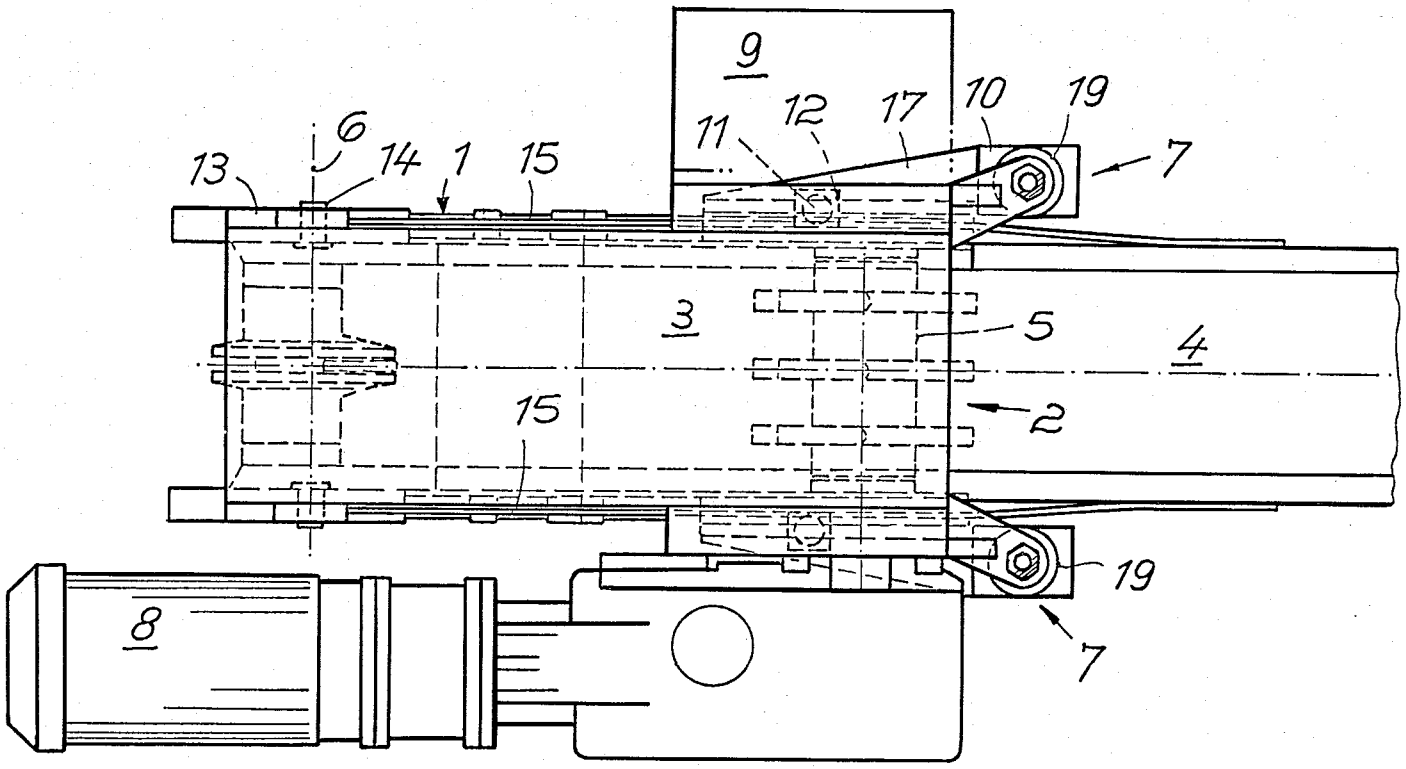
FIG. 2 is a top plan view of the crushing device of FIG. 1.
Figure 3:
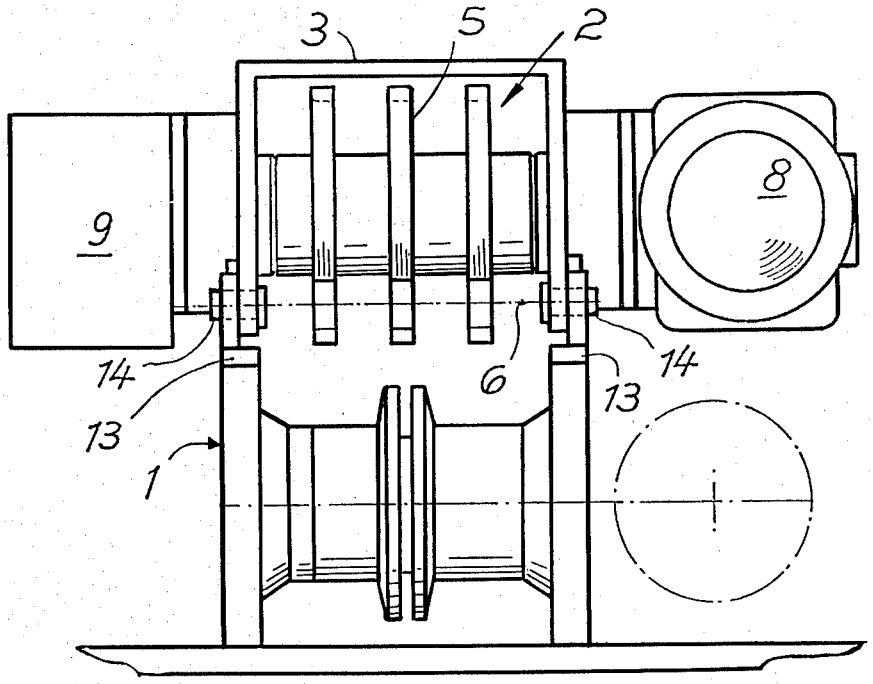
FIG. 3 is a front view of the device of FIG. 1.
Figure 4:
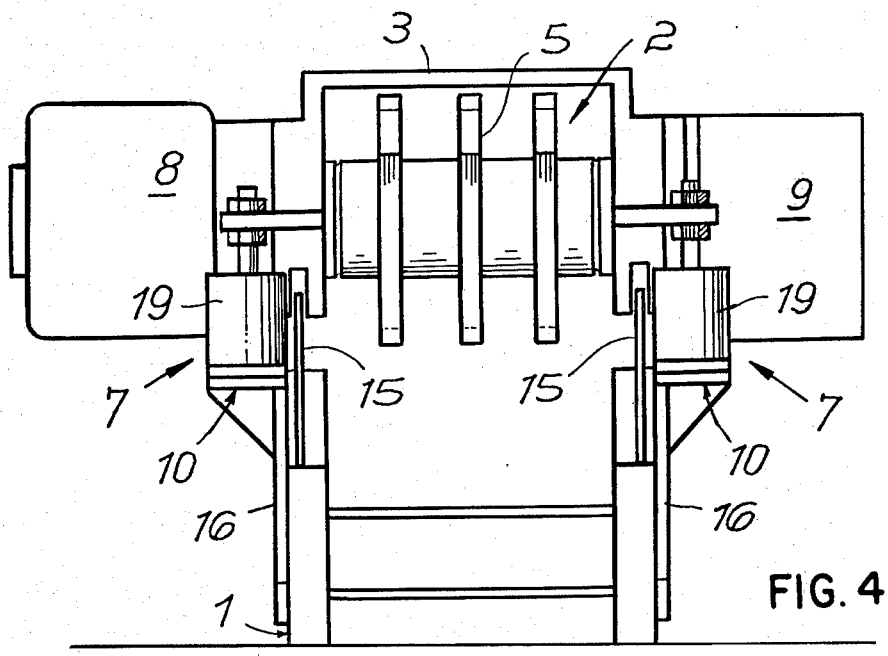
FIG. 4 is a vertical sectional view taken along the line 4—4 of FIG. 1.

Referring to the drawings, in particular, wherein like reference numerals designate like or corresponding parts throughout the several views; there is shown a crushing device including a continuous crusher 2 mounted on a base frame 1 of a conveyor, particularly single-chain conveyor. The crusher 2 includes a housing 3 and a crusher roll 5 mounted within the housing, which operates on coarse material on conveyor trough 4 located therebelow. Crusher housing 3 is swingably mounted, at the outlet end of base frame 1, for oscillatory motion about a horizontal swing axis 6 and is supported, at the inlet end of base frame 1, by means of damping elements 7.

A drive assembly 8 for crusher roll 5 is laterally connected to crusher housing 3. The center of gravity S of drive assembly 8 is located on a horizontal projection of a vertical line 0 intersecting the swing axis 6 of housing 3. At the housing side opposite to drive assembly 8, a counterweight 9 of adequate magnitude is secured to crusher housing 3.

Damping elements 7 are supported on brackets 10 which are laterally secured to base frame 1.

Crusher housing 3 is guided by means of guide pin 11 which is received with a predetermined clearance for motion in the sockets of substantially vertically extending guide boxes 12 located in the area between damping elements 7 and swing axis 6. The guide pin, as illustrated in FIG. 1, includes an enlarged head portion and a base portion fixedly connected to the housing. The socket of the guide boxes 12 are proportioned for receiving the enlarged head portion of the guide pins 11 so that the guide pin is guidedly movable in the socket. Bearing supports 13 for journals 14 of housing 3 are provided on base frame 1.

Side sheets 15 connected to bearing supports 13 are supported in upright position on the side walls of base frame 1, or connected thereto, without leaving a gap, and engage by their other side over side walls of the crusher housing 3 or are received in recesses provided in the side walls of crusher housing 3. A closed or slitless transition from housing 3 to base frame 1 is thereby obtained, even during the oscillatory motion of crushing housing 3.

In the vicinity of the inlet end, side plates 16 are connected to base frame 1. The plates 16 support the brackets 10 for damping elements 7. Supporting flanges 17 mounted on side plates 16 provide support for guide boxes 12, in which the guide pin 11 secured to crusher housing 3 are guided with a predetermined clearance of motion.

Damping elements 7 are designed as metal-rubber elements comprising a damping piston 18 having a stem with a base portion which is connected to crusher housing 3, and a damping cylinder 19 which is secured to bracket 10 and has a cavity filled with rubber packs 20 on both sides of a head portion of damping piston 18. Surprisingly, due to the provided compensation for inertia forces relative to drive assembly 8, otherwise required pneumatic or hydraulic piston-and-cylinder systems become unnecessary as damping elements. According to a preferred embodiment of the invention (not shown) swing axis 6 coincides with the center-of-gravity axis of drive assembly 8.

While a specific embodiment of the invention has been shown and described in detail to illustrate the application of the principles of the invention, it will be understood that the invention may be embodied otherwise without departing from such principles.

What is claimed is:

1. A crushing device for fragmenting coarse material comprising a frame, an elongated housing, means for mounting said housing to said frame for oscillatory motion about a horizontal swing axis adjacent a first end of said housing, a rotatable crushing roller mounted in said housing adjacent a second end opposite to said housing first end, a conveyor trough movably mounted to said frame spaced from said crushing roller by a distance defining a passage clearance for the material to be crushed therebetween, means for damping the oscillatory motion of said housing, drive means laterally connected to a first side of said housing for driving said crushing roller, and a counterweight laterally connected to a second side of said housing, said second side being disposed opposite said first side, for counterbalancing said drive means, said drive means having a center of gravity substantially disposed on a vertical line perpendicularly to said horizontal swing axis.

2. The crushing device as set forth in claim 1 further comprising a guide pin connected to said housing, a guide box having a substantially vertically extending socket mounted on said frame intermediate said mounting means and said damping means, and said socket being proportioned for movably receiving and guiding said guide pin.

3. The crushing device as set forth in claim 1 further comprising a guide box connected to said frame intermediate said mounting means and said damping means, a guide pin having an enlarged head portion and a base portion fixedly connected to said housing, said guide box including a substantially vertically extending socket and said socket being proportioned for receiving the enlarged head portion of said guide pin so that said guide pin is guidably movable in said socket.

4. The crushing device as set forth in claim 1 wherein said mounting means comprises a bearing connected to said frame, and a journal connected to said housing rotatably received in said bearing.

5. The crushing device as set forth in claim 4 wherein said frame includes side sheets respectively overlying the first and second sides of said housing.

6. The crushing device as set forth in claim 4 wherein said first and second sides of said housing include a recess, and said frame includes side sheets, each of said side sheets extending vertically into a respective one of said recesses.

7. The crushing device as set forth in claim 2 wherein said frame includes vertically extending side plates and a bracket connected to each of said plates for supporting said damping means and said guide box.

8. The crushing device as set forth in claim 1 wherein said damping means includes a damping piston having a stem with base portion connected to said housing and a head portion, and a damping cylinder connected to said frame including an inner cavity dimensioned for receiving said head portion, and a rubber-like packing filling said cavity on opposite sides of said head portion.

9. The crushing device as set forth in claim 2 wherein said damping means includes a damping piston having a stem with base portion connected to said housing and a head portion, and a damping cylinder connected to said frame including an inner cavity dimensioned for receiving said head portion, and a rubber-like packing filling said cavity on opposite sides of said head portion.

10. The crushing device as set forth in claim 1 wherein said drive means has a center of gravity substantially disposed at said horizontal swing axis.

* * * * *